US010251449B2

(12) United States Patent
Dojan et al.

(10) Patent No.: US 10,251,449 B2
(45) **Date of Patent: *Apr. 9, 2019**

(54) ARTICLE OF FOOTWEAR INCORPORATING TENSILE STRANDS AND SECURING STRANDS

(71) Applicant: NIKE, Inc., Beaverton, OR (US)

(72) Inventors: Frederick J. Dojan, Vancouver, WA (US); Chin-Chen Huang, Taichung (TW); James C. Meschter, Portland, OR (US); Lia Uesato, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 95 days.

This patent is subject to a terminal disclaimer.

(21) Appl. No.: 15/211,001

(22) Filed: Jul. 15, 2016

(65) Prior Publication Data

US 2016/0324266 A1 Nov. 10, 2016

Related U.S. Application Data

(62) Division of application No. 14/707,215, filed on May 8, 2015, now Pat. No. 9,420,850, which is a division of application No. 13/557,094, filed on Jul. 24, 2012, now Pat. No. 9,055,785, which is a division of application No. 12/546,022, filed on Aug. 24, 2009, now Pat. No. 8,266,827.

(51) Int. Cl.

| | |
|---|---|
| ***A43B 23/02*** | (2006.01) |
| ***A43C 1/00*** | (2006.01) |
| ***A43B 7/14*** | (2006.01) |

(52) U.S. Cl.
CPC ..... *A43B 23/0265* (2013.01); *A43B 7/14* (2013.01); *A43B 23/025* (2013.01); *A43C 1/00* (2013.01)

(58) Field of Classification Search
CPC ..... A43B 23/0265; A43B 23/025; A43B 23/0245; A43B 1/02; A43B 1/04; A43C 1/00; A43C 1/04
See application file for complete search history.

(56) References Cited

U.S. PATENT DOCUMENTS

| | | | | |
|---|---|---|---|---|
| 2,052,753 A * | 9/1936 | Daniels | A43B 1/0027 12/142 V |
| 3,138,880 A * | 6/1964 | Werner | A43B 5/02 36/105 |
| 8,122,616 B2 * | 2/2012 | Meschter | A43B 23/227 36/45 |
| 8,266,827 B2 * | 9/2012 | Dojan | A43B 23/025 36/45 |
| 9,055,785 B2 * | 6/2015 | Dojan | A43B 23/025 |

(Continued)

*Primary Examiner* — Ted Kavanaugh
(74) *Attorney, Agent, or Firm* — Klarquist Sparkman, LLP

(57) ABSTRACT

An article of footwear may have a sole structure and an upper that includes a foundation element, a tensile strand, and a securing strand. The tensile strand is located adjacent to an exterior surface of the foundation element and substantially parallel to the exterior surface for a distance of at least five centimeters. The securing strand joins or secures the tensile strand to the foundation element. Although the thicknesses may vary, a thickness of the tensile strand may be at least three times the thickness of the securing strand. In some configurations, a backing strand may also assist with joining the securing strand to the foundation element.

20 Claims, 15 Drawing Sheets

(56) References Cited

U.S. PATENT DOCUMENTS

| | | | | |
|---|---|---|---|---|
| 9,420,850 | B2 * | 8/2016 | Dojan | A43B 23/025 |
| 2004/0181972 | A1 * | 9/2004 | Csorba | A43B 7/1495 36/50.1 |
| 2007/0271821 | A1 * | 11/2007 | Meschter | A43B 3/26 36/45 |
| 2008/0022554 | A1 * | 1/2008 | Meschter | A43B 7/14 36/45 |
| 2010/0154256 | A1 * | 6/2010 | Dua | A43B 1/04 36/25 R |

* cited by examiner

ARTICLE OF FOOTWEAR INCORPORATING TENSILE STRANDS AND SECURING STRANDS

CROSS-REFERENCE TO RELATED APPLICATIONS

This application is a division of U.S. patent application Ser. No. 14/707,215, which was filed on May 8, 2015 and entitled "Article Of Footwear Incorporating Tensile Strands And Securing Strands", which application is a division of U.S. patent application Ser. No. 13/557,094, which was filed on Jul. 24, 2012 and entitled "Article Of Footwear Incorporating Tensile Strands And Securing Strands", and issued on Jun. 16, 2015 as U.S. Pat. No. 9,055,785, which application is a division of U.S. patent application Ser. No. 12/546,022, which was filed in the U.S. Patent and Trademark Office on Aug. 24, 2009 and entitled "Article Of Footwear Incorporating Tensile Strands And Securing Strands", and issued on Sep. 18, 2012 as U.S. Pat. No. 8,266,827, such prior applications being entirely incorporated herein by reference in their entirety.

BACKGROUND

Articles of footwear generally include two primary elements: an upper and a sole structure. The upper is often formed from a plurality of material elements (e.g., textiles, polymer sheet layers, foam layers, leather, synthetic leather) that are stitched or adhesively bonded together to form a void on the interior of the footwear for comfortably and securely receiving a foot. More particularly, the upper forms a structure that extends over instep and toe areas of the foot, along medial and lateral sides of the foot, and around a heel area of the foot. The upper may also incorporate a lacing system to adjust fit of the footwear, as well as permitting entry and removal of the foot from the void within the upper. In addition, the upper may include a tongue that extends under the lacing system to enhance adjustability and comfort of the footwear, and the upper may incorporate a heel counter.

The various material elements forming the upper impart specific properties to different areas of the upper. For example, textile elements may provide breathability and may absorb moisture from the foot, foam layers may compress to impart comfort, and leather may impart durability and wear-resistance. As the number of material elements increases, the overall mass of the footwear may increase proportionally. The time and expense associated with transporting, stocking, cutting, and joining the material elements may also increase. Additionally, waste material from cutting and stitching processes may accumulate to a greater degree as the number of material elements incorporated into an upper increases. Moreover, products with a greater number of material elements may be more difficult to recycle than products formed from fewer material elements. By decreasing the number of material elements, therefore, the mass of the footwear and waste may be decreased, while increasing manufacturing efficiency and recyclability.

The sole structure is secured to a lower portion of the upper so as to be positioned between the foot and the ground. In athletic footwear, for example, the sole structure includes a midsole and an outsole. The midsole may be formed from a polymer foam material that attenuates ground reaction forces (i.e., provides cushioning) during walking, running, and other ambulatory activities. The midsole may also include fluid-filled chambers, plates, moderators, or other elements that further attenuate forces, enhance stability, or influence the motions of the foot, for example. The outsole forms a ground-contacting element of the footwear and is usually fashioned from a durable and wear-resistant rubber material that includes texturing to impart traction. The sole structure may also include a sockliner positioned within the upper and proximal a lower surface of the foot to enhance footwear comfort.

SUMMARY

An article of footwear is disclosed below as having an upper and a sole structure secured to the upper. The upper includes a foundation element having an interior surface and an opposite exterior surface, the interior surface defining at least a portion of a void within the upper for receiving a foot of a wearer. A tensile strand is located adjacent to the exterior surface and substantially parallel to the exterior surface for a distance of at least five centimeters, and the tensile strand has a first thickness. A securing strand joins or secures the tensile strand to the foundation element. The securing strand has a second thickness, the first thickness being at least three times the second thickness. In some configurations, a backing strand may also assist with joining the securing strand to the foundation element.

A method of manufacturing an article of footwear is also disclosed. The method includes laying a tensile strand against an exterior surface of an upper of the article of footwear. The tensile strand is positioned substantially parallel to the exterior surface for a distance of at least five centimeters. The method also includes stitching over the tensile strand with a securing strand to secure the securing strand to the exterior surface at a plurality of locations on opposite sides of the tensile strand.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

BRIEF DESCRIPTION OF THE DRAWINGS

The foregoing Summary and the following Detailed Description will be better understood when read in conjunction with the accompanying figures.

DETAILED DESCRIPTION

The following discussion and accompanying figures disclose various configurations of an article of footwear incorporating tensile strands. The article of footwear is disclosed as having a general configuration suitable for walking or running. Concepts associated with the article of footwear may also be applied to a variety of other footwear types, including baseball shoes, basketball shoes, cross-training shoes, cycling shoes, football shoes, tennis shoes, soccer shoes, and hiking boots, for example. The concepts may also be applied to footwear types that are generally considered to be non-athletic, including dress shoes, loafers, sandals, and work boots. The various concepts disclosed herein apply, therefore, to a wide variety of footwear types. In addition to footwear, the tensile strands or concepts associated with the tensile strands may be incorporated into a variety of other products.

General Footwear Structure

Figure 1:
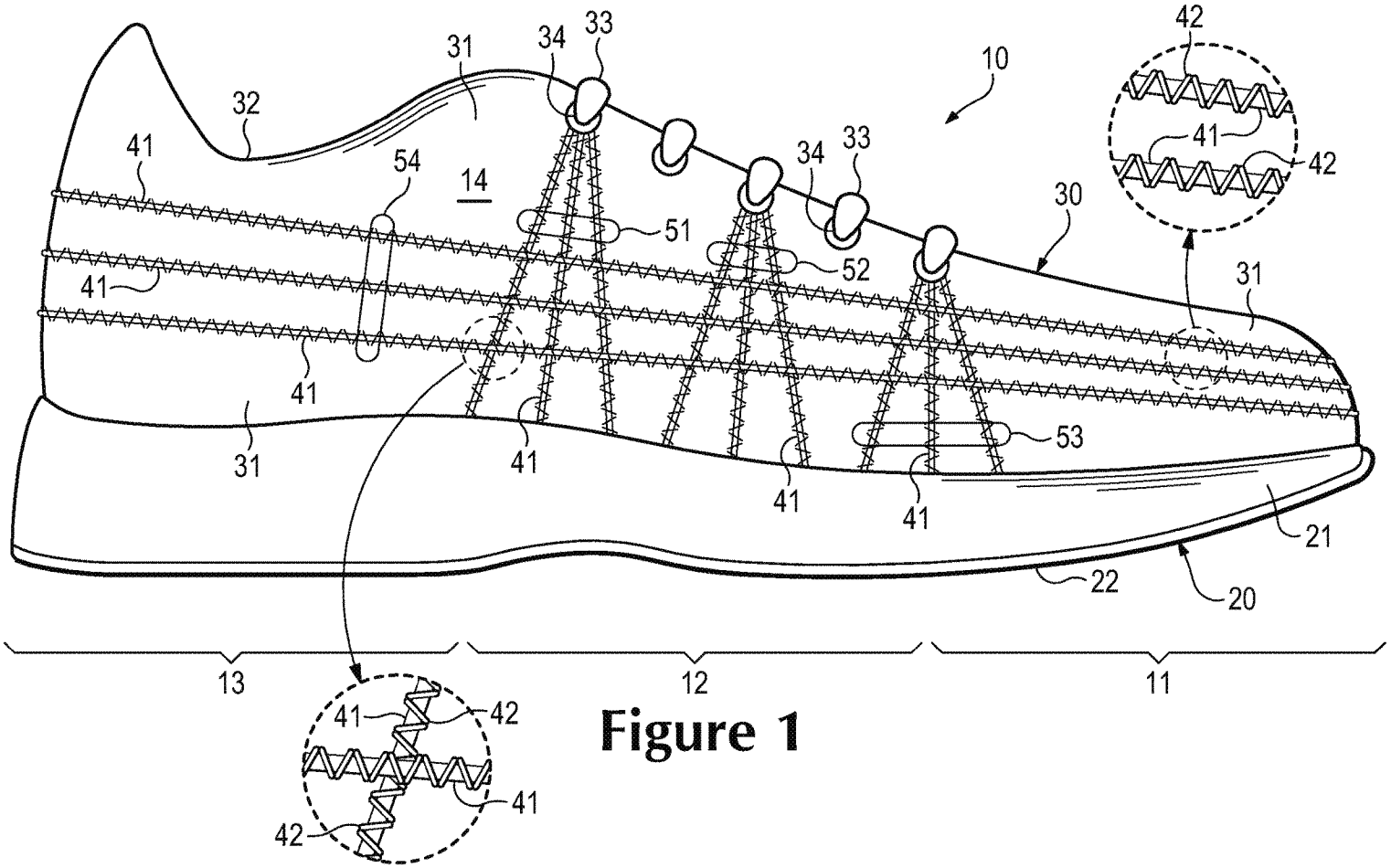
FIG. 1 is a lateral side elevational view of an article of footwear.
Figure 2:
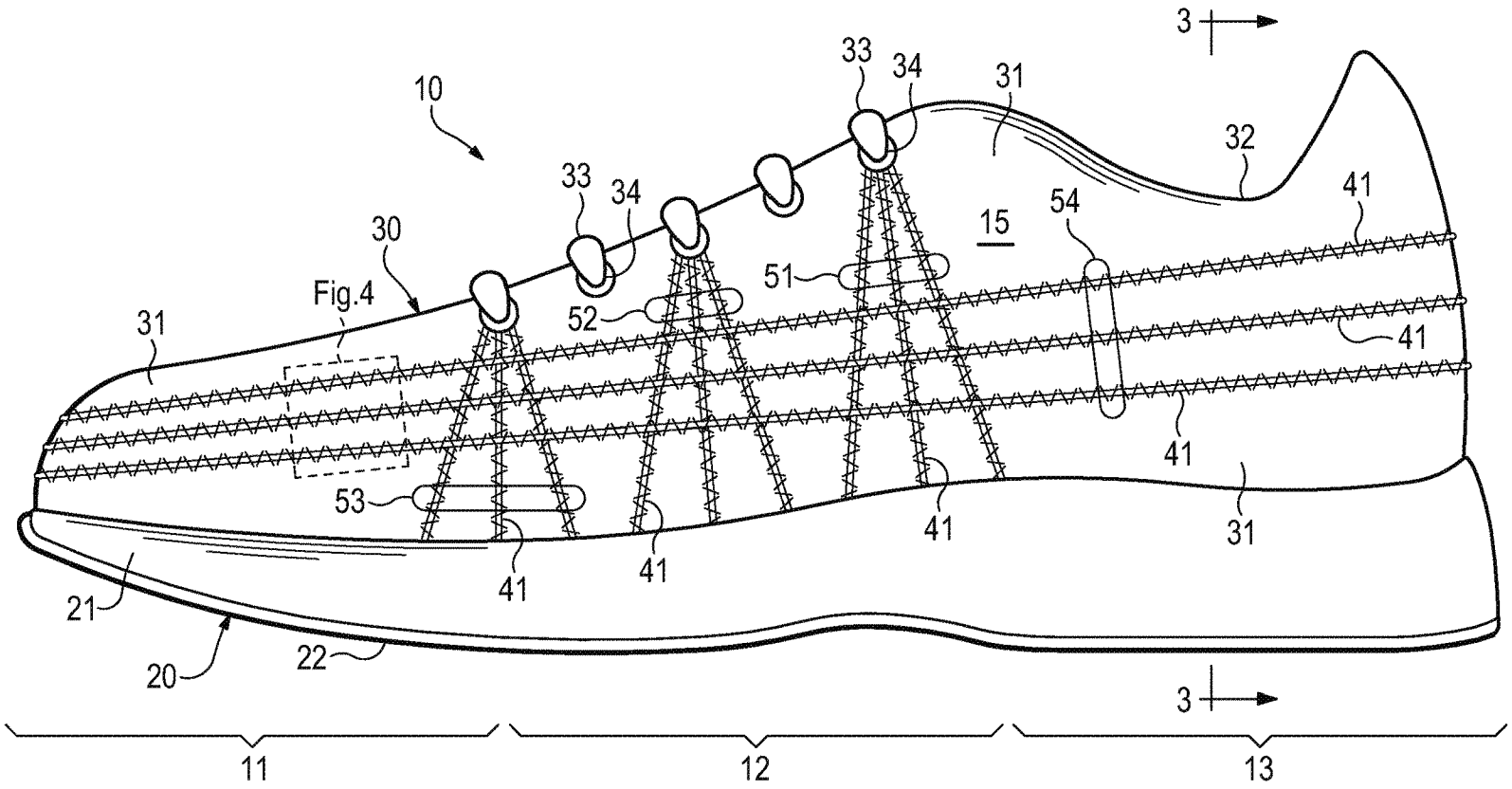
FIG. 2 is a medial side elevational view of the article of footwear.
Figure 3:
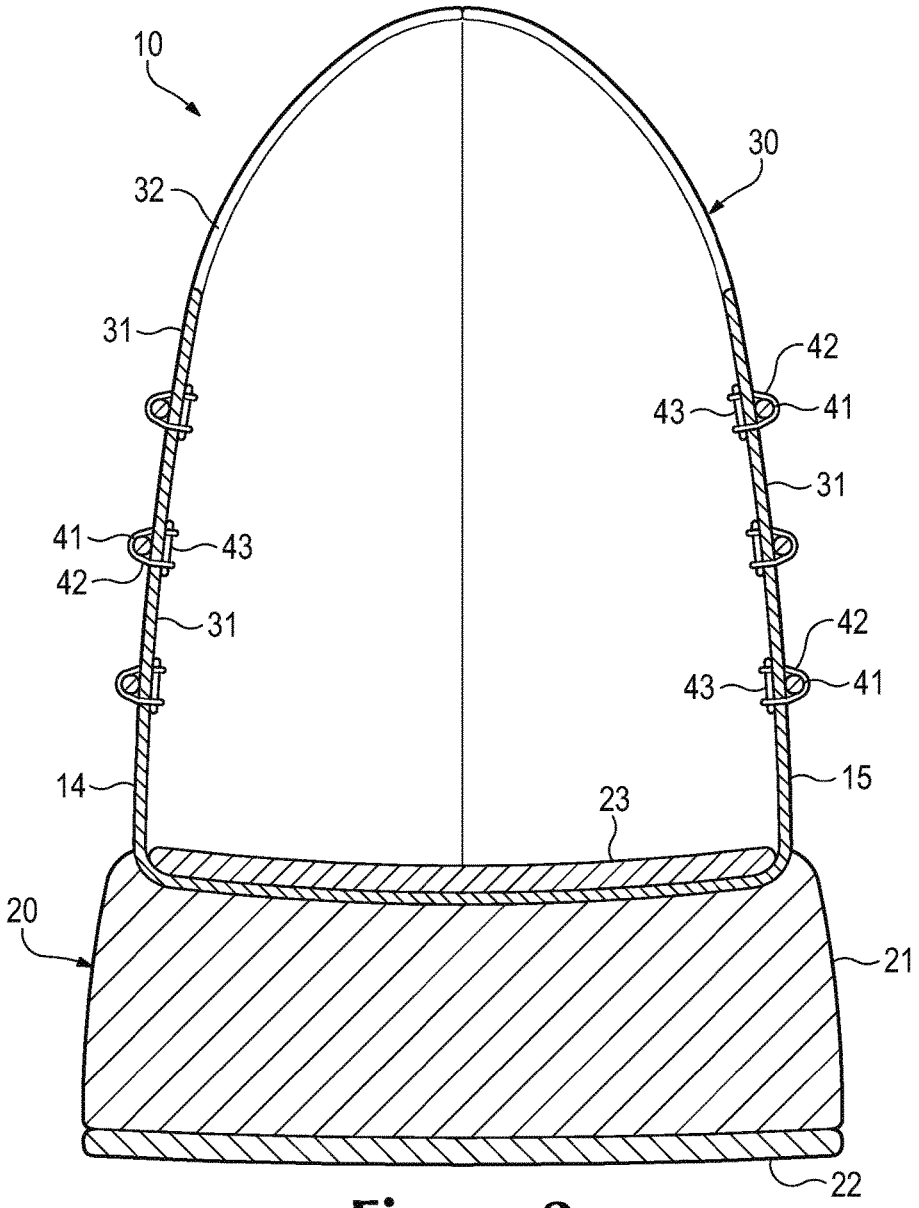
FIG. 3 is a cross-sectional view of the article of footwear, as defined by section line 3-3 in FIG. 2.
Figure 4:
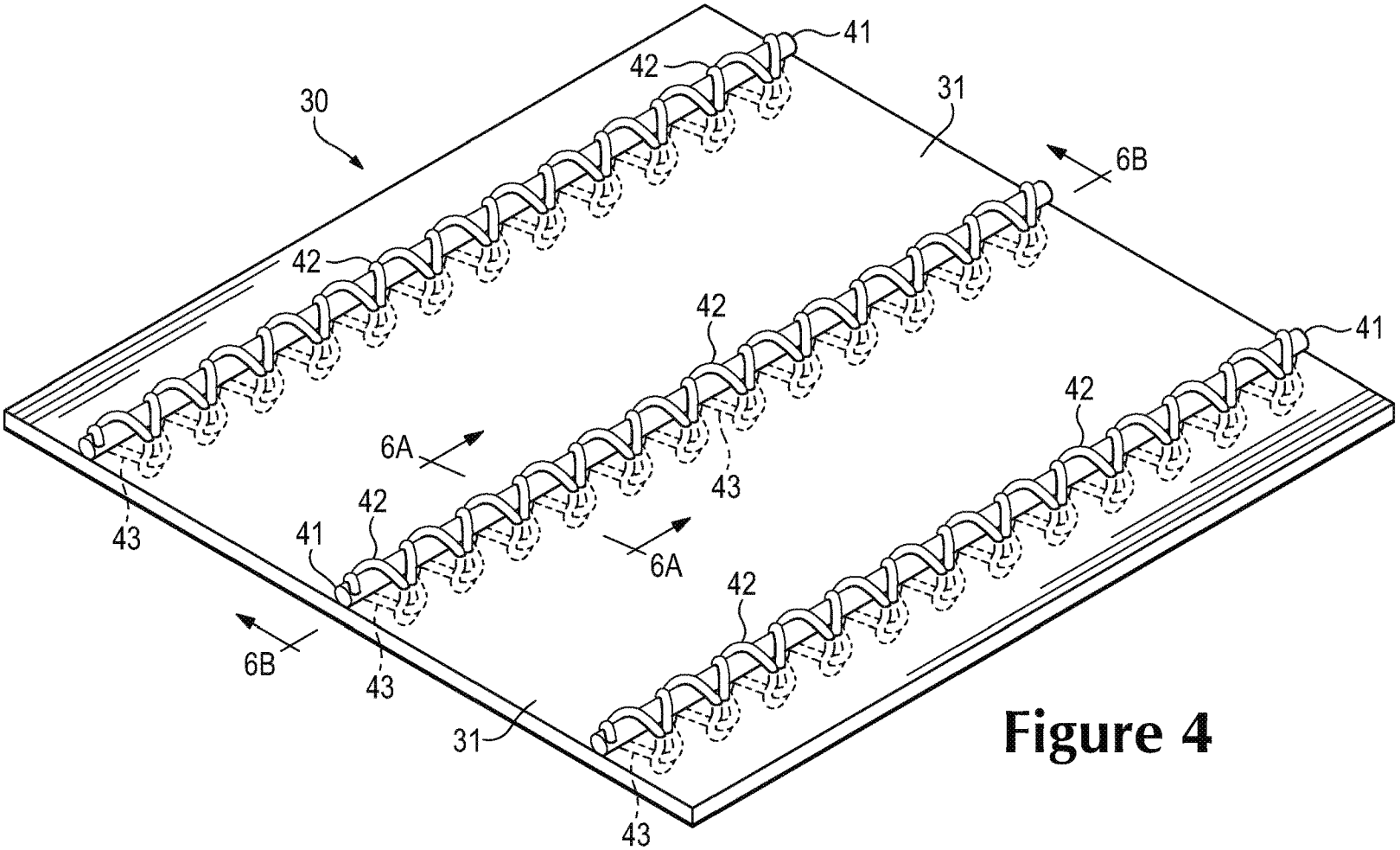
FIG. 4 is a perspective view of a portion of an upper of the article of footwear, as defined in FIG. 2.
Figure 5:
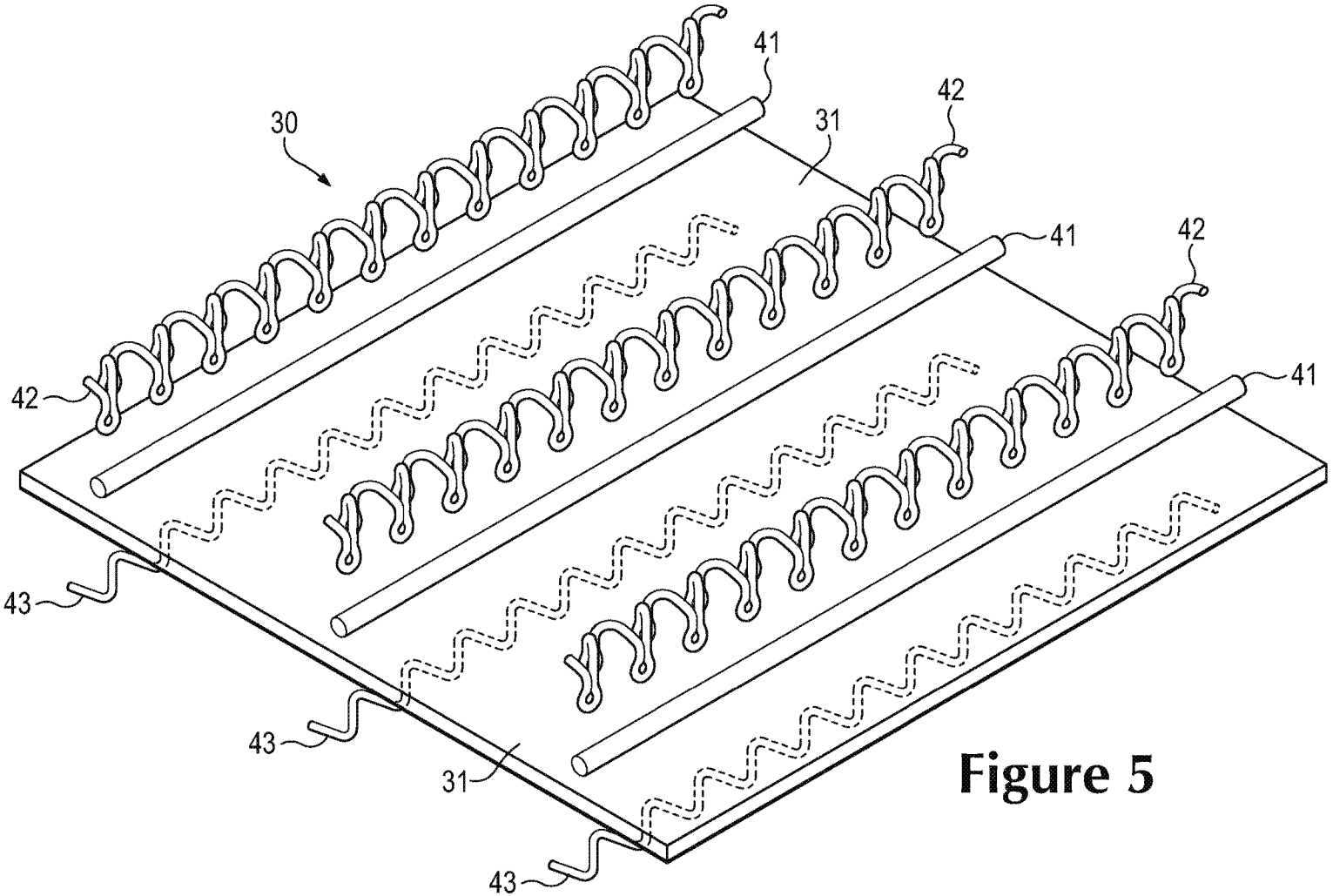
FIG. 5 is an exploded perspective view of the portion of the upper.
Figure 6A:
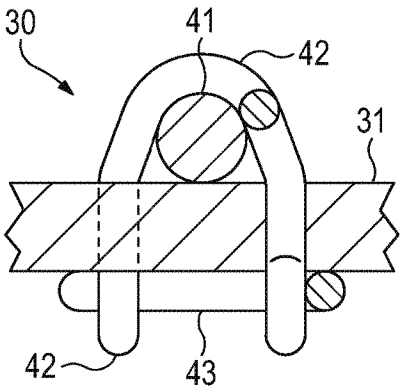
FIGS. 6A and 6B are a cross-sectional views of the portion of the upper, as defined by section lines 6A and 6B in FIG. 4.
Figure 6B:
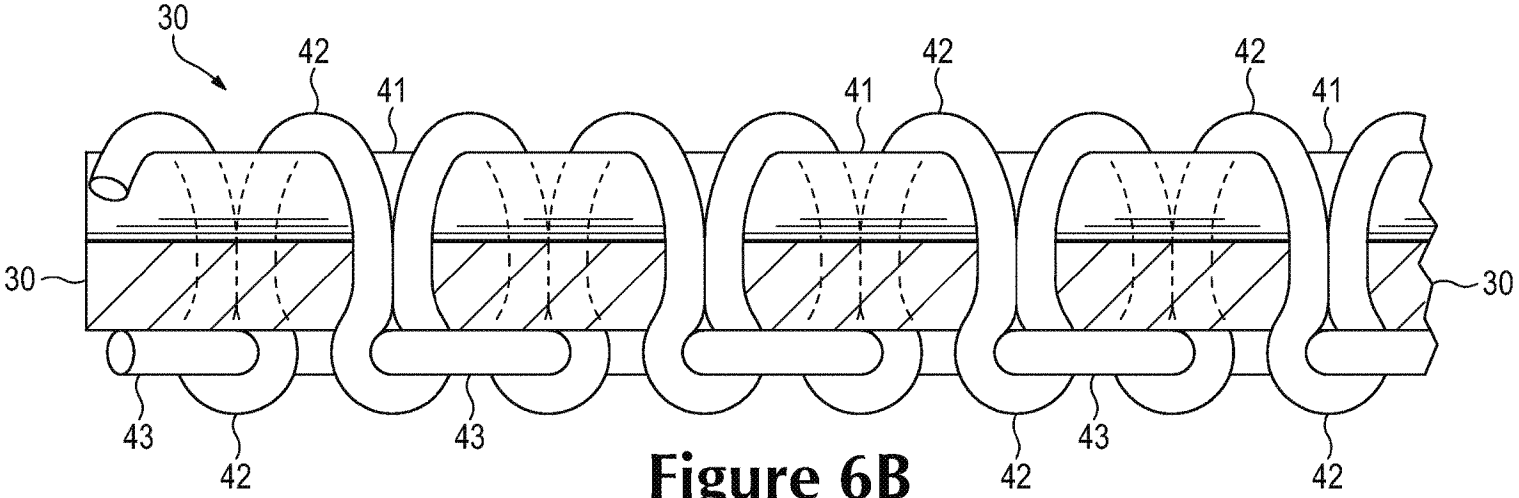

An article of footwear 10 is depicted in FIGS. 1-3 as including a sole structure 20 and an upper 30. For reference purposes, footwear 10 may be divided into three general regions: a forefoot region 11, a midfoot region 12, and a heel region 13, as shown in FIGS. 1 and 2. Footwear 10 also includes a lateral side 14 and a medial side 15. Forefoot region 11 generally includes portions of footwear 10 corresponding with the toes and the joints connecting the metatarsals with the phalanges. Midfoot region 12 generally includes portions of footwear 10 corresponding with the arch area of the foot, and heel region 13 corresponds with rear portions of the foot, including the calcaneus bone. Lateral side 14 and medial side 15 extend through each of regions 11-13 and correspond with opposite sides of footwear 10. Regions 11-13 and sides 14-15 are not intended to demarcate precise areas of footwear 10. Rather, regions 11-13 and sides 14-15 are intended to represent general areas of footwear 10 to aid in the following discussion. In addition to footwear 10, regions 11-13 and sides 14-15 may also be applied to sole structure 20, upper 30, and individual elements thereof.

Sole structure 20 is secured to upper 30 and extends between the foot and the ground when footwear 10 is worn. The primary elements of sole structure 20 are a midsole 21, an outsole 22, and a sockliner 23. Midsole 21 is secured to a lower surface of upper 30 and may be formed from a compressible polymer foam element (e.g., a polyurethane or ethylvinylacetate foam) that attenuates ground reaction forces (i.e., provides cushioning) when compressed between the foot and the ground during walking, running, or other ambulatory activities. In additional configurations, midsole 21 may incorporate fluid-filled chambers, plates, moderators, or other elements that further attenuate forces, enhance stability, or influence motions of the foot, or midsole 21 may be primarily formed from a fluid-filled chamber. Outsole 22 is secured to a lower surface of midsole 21 and may be formed from a wear-resistant rubber material that is textured to impart traction. Sockliner 23 is located within upper 30 and is positioned to extend under a lower surface of the foot. Although this configuration for sole structure 20 provides an example of a sole structure that may be used in connection with upper 30, a variety of other conventional or nonconventional configurations for sole structure 20 may also be utilized. Accordingly, the configuration and features of sole structure 20 or any sole structure utilized with upper 30 may vary considerably.

Upper 30 is secured to sole structure 20 and includes a foundation element 31 that defines a void within footwear 10 for receiving and securing a foot relative to sole structure 20. More particularly, an interior surface of foundation element 31 forms at least a portion of the void within upper 30. As depicted, foundation element 31 is shaped to accommodate the foot and extends along the lateral side of the foot, along the medial side of the foot, over the foot, around the heel, and under the foot. In other configurations, foundation element 31 may only extend over or along a portion of the foot, thereby forming only a portion of the void within upper 30. Access to the void within foundation element 31 is provided by an ankle opening 32 located in at least heel region 13. A lace 33 extends through various lace apertures 34, which extend through foundation element 31, and permit the wearer to modify dimensions of upper 30 to accommodate the proportions of the foot. More particularly, lace 33 permits the wearer to tighten upper 30 around the foot, and lace 33 permits the wearer to loosen upper 30 to facilitate entry and removal of the foot from the void (i.e., through ankle opening 32). In addition, foundation element 31 may include a tongue (not depicted) that extends under lace 33.

The various portions of foundation element 31 may be formed from one or more of a plurality of material elements (e.g., textiles, polymer sheets, foam layers, leather, synthetic leather) that are stitched or bonded together to form the void within footwear 10. Referring to FIG. 3, foundation element 31 is depicted as being formed from a single material layer, but may also be formed from multiple material layers that each impart different properties, as discussed in greater detail below with respect to FIG. 8A. As noted above, foundation element 31 extends along the lateral side of the foot, along the medial side of the foot, over the foot, around the heel, and under the foot. Moreover, an interior surface of foundation element 31 contacts the foot (or a sock worn over the foot), whereas an exterior surface of foundation element 31 forms at least a portion of an exterior surface of upper 30. Although the material elements forming foundation element 31 may impart a variety of properties to upper 30, a plurality of tensile strands 41 are secured to each of lateral side 14 and medial side 15 and, more particularly, are secured to the exterior surface of foundation element 31 with various securing strands 42 and backing strands 43.

Strand Configuration

Tensile strands 41 are depicted in FIGS. 1 and 2 as extending in a generally (a) vertical direction between lace apertures 34 and sole structure 20 and (b) horizontal direction between forefoot region 11 and heel region 13 on both of lateral side 14 and medial side 15. Referring also to FIG. 3, tensile strands 41 are located between an exterior surface of foundation element 31 and one of securing strands 42. Although tensile strands 41 are located on both of sides 14 and 15, tensile strands 41 may be limited to one of sides 14 and 15 in some configurations of footwear 10. Additionally, tensile strands 41 may only extend through a portion of the distance between (a) lace apertures 34 and sole structure 20 and (b) forefoot region 11 and heel region 13. As discussed in greater detail below, therefore, the location and various other aspects relating to tensile strands 41 may vary significantly.

During walking, running, or other ambulatory activities, a foot within the void in footwear 10 may tend to stretch upper 30. That is, many of the material elements forming upper 30, including foundation element 31, may stretch when placed in tension by movements of the foot. Although tensile strands 41 may also stretch, tensile strands 41 generally stretch to a lesser degree than the other material elements forming upper 30 (e.g., foundation element 31). Each of tensile strands 41 may be located, therefore, to form structural components in upper 30 that resist stretching in specific directions or reinforce locations where forces are concentrated. As an example, the various tensile strands 41 that extend between lace apertures 34 and sole structure 20 resist stretch in the medial-lateral direction (i.e., in a direction extending around upper 30). These tensile strands 41 are also positioned adjacent to and radiate outward from lace apertures 34 to resist stretch due to tension in lace 33. As another example, the various tensile strands 41 that extend between forefoot region 11 and heel region 13 resist stretch in a longitudinal direction (i.e., in a direction extending through each of regions 11-13). Accordingly, tensile strands 41 are located to form structural components in upper 30 that resist stretch.

A portion of upper 30 is depicted in FIG. 4-6B. In addition to foundation element 31, the portion of upper 30 includes the various tensile strands 41, securing strands 42, and backing strands 43. Whereas tensile strands 41 lie adjacent to the exterior surface of foundation element 31 and substantially parallel to the exterior surface of foundation element 31, securing strands 42 extend over tensile strands 41 and join with foundation element 31 to effectively secure the positions of tensile strands 41. More particularly, securing strands 42 extend through foundation element 31 and wrap around backing strands 43. A cording machine or other mechanical sewing or stitching device may be utilized to form portions of upper 30. When lockstitches are utilized, securing strands 42 extend through foundation element 31 and wrap around backing strands 43 to effectively lock securing strands 42 in place, thereby preventing unraveling of securing strands 42. In this manner, securing strands 42 are secured to foundation element 31 in a conventional manner (i.e., with a lockstitch) that includes wrapping around backing strands 43 on a opposite or interior surface of foundation element 31.

Tensile strands 41, as discussed above, form structural components in upper 30 that resist stretch. By being substantially parallel to the exterior surface of foundation element 31, tensile strands 41 resist stretch in directions that correspond with the planes of foundation element 31. Although tensile strands 41 may extend through foundation element 31 (e.g., as a result of stitching) in some locations, areas where tensile strands 41 extend through foundation element 31 may permit stretch, thereby reducing the overall ability of tensile strands 41 to limit stretch. As a result, each of tensile strands 41 generally lie adjacent to the exterior surface of foundation element 31 and substantially parallel to the exterior surface of foundation element 31 for distances of at least twelve millimeters, and may lie adjacent to the exterior surface of foundation element 31 and substantially parallel to the exterior surface of foundation element 31 for distances of at least five centimeters or more.

Securing strands 42 repeatedly extend over tensile strands 41 and are secured to foundation element 31 on opposite sides of tensile strands 41. In this configuration, securing strands 42 are secured to foundation element 31 at a plurality of locations on opposite sides of the tensile strands 41 and form, for example, a zigzag pattern along at least a portion of the lengths of tensile strands 41. As noted above, each of tensile strands 41 may lie adjacent to and substantially parallel to the exterior surface of foundation element 31 for distances of at least five centimeters or more. In this configuration, securing strands 42 are joined to foundation element 31 at a plurality of locations on opposite sides of the tensile strands 41 and along the distance of at least five centimeters to secure the tensile strands 41 to foundation element 31. Moreover, this configuration locates tensile strands 41 between securing strands 42 and foundation element 31. Although adhesives or other joining mechanisms may be used to secure tensile strands 41 to foundation element 31 or supplement the securing of tensile strands 41 to foundation element 31, securing strands 42 may be solely responsible for securing tensile strands 41 to foundation element 31 in many configurations of footwear 10. Moreover, backing strands 43 may be absent in some configurations.

Strands 41, 42, and 43 may be formed from a variety of filaments, fibers, yarns, threads, cables, or ropes that are formed from rayon, nylon, polyester, polyacrylic, silk, cotton, carbon, glass, aramids (e.g., para-aramid fibers and meta-aramid fibers), ultra high molecular weight polyethylene, liquid crystal polymer, copper, aluminum, and steel, for example. Whereas filaments have an indefinite length and may be utilized individually as any of strands 41, 42, and 43, fibers have a relatively short length and generally go through spinning or twisting processes to produce a strand of suitable length. An individual filament utilized as either of strands 41, 42, and 43 may be formed form a single material (i.e., a monocomponent filament) or from multiple materials (i.e., a bicomponent filament). Similarly, different filaments may be formed from different materials. As an example, yarns utilized as strands 41, 42, and 43 may include filaments that are each formed from a common material, may include filaments that are each formed from two or more different materials, or may include filaments that are each formed from two or more different materials. Similar concepts also apply to threads, cables, or ropes. Although strands 41, 42, and 43 will often have a cross-section where width and thickness are substantially equal (e.g., a round or square cross-section), suitable cross-sections may have a width that is greater than a thickness (e.g., a rectangular, oval, or otherwise elongate cross-section).

Strands 41, 42, and 43 may be formed from the same material, or may be formed from different materials. For example, tensile strands 41 may be formed from polyethylene, whereas strands 42 and 43 may be formed from nylon. As another example, strands 41 and 42 may be formed from polyester, whereas backing strands 43 are formed from cotton. Similarly, some of tensile strands 41 may be formed from aramids, whereas other tensile strands 41 may be formed from silk. The materials utilized for strands 41, 42, and 43 may vary, therefore, to impart different properties to different areas of upper 30.

The diameter or thicknesses of strands 41, 42, and 43 may also vary significantly to range from 0.03 millimeters to more than 5 millimeters, for example. Based upon the above discussion, tensile strands 41 are located to form structural components in upper 30 that resist stretch, whereas securing strands 42 and backing strands 43 are cooperatively utilized to secure the position of tensile strands 41 upon foundation element 31. Given that tensile strands 41 are utilized to resist stretch and may be subjected to substantial tensile forces, the materials and thicknesses of tensile strands 41 may be selected to bear the tensile forces without breaking, yielding, or otherwise failing. Similarly, the materials and thicknesses of securing strands 42 and backing strands 43 may be selected to ensure that tensile strands remain properly positioned relative to foundation element 31. In many configurations for footwear 10, the tensile forces upon tensile strands 41 are significantly greater than the forces subjected to securing strands 42 and backing strands 43. As a result, the diameter or thickness of tensile strands 41 may be greater than the diameters or thicknesses of securing strands 42 and backing strands 43. In many configurations, the thickness of tensile strands 41 will be at least three times the thicknesses of securing strands 42 and backing strands 43 to provide the additional strength to tensile strands 41. In other configurations, the thickness of tensile strands 41 will be more than two times or more than five the thicknesses of securing strands 42 and backing strands 43. In general, therefore, the thickness of tensile strands 41 ranges from two to ten times or more of the thickness of securing strands 42 and backing strands 43. In addition to strength properties, forming tensile strands 41 to have greater thickness (i.e., three times the thickness) than securing strands 42 imparts distinctive aesthetic properties to footwear 10.

Based upon the above discussion, upper 30 has a configuration wherein foundation element 31 has an interior surface and an opposite exterior surface. Tensile strands 41 are located adjacent to the exterior surface of foundation element 31 and substantially parallel to the exterior surface for a distance of at least five centimeters in some configurations. Securing strands 42, sometimes in combination with backing strands 43, effectively secure tensile strands 41 to foundation element 31. Although the thicknesses may vary, tensile strands 31 may have thicknesses that are at least three times the thicknesses of securing strands 42.

Structural Components

A conventional upper may be formed from multiple material layers that each impart different properties to various areas of the upper. During use, an upper may experience significant tensile forces, and one or more layers of material are positioned in areas of the upper to resist the tensile forces. That is, individual layers may be incorporated into specific portions of the upper to resist tensile forces that arise during use of the footwear. As an example, a woven textile may be incorporated into an upper to impart stretch resistance in the longitudinal direction. A woven textile is formed from yarns that interweave at right angles to each other. If the woven textile is incorporated into the upper for purposes of longitudinal stretch-resistance, then only the yarns oriented in the longitudinal direction will contribute to longitudinal stretch-resistance, and the yarns oriented orthogonal to the longitudinal direction will not generally contribute to longitudinal stretch-resistance. Approximately one-half of the yarns in the woven textile are, therefore, superfluous to longitudinal stretch-resistance. As an extension of this example, the degree of stretch-resistance required in different areas of the upper may vary. Whereas some areas of the upper may require a relatively high degree of stretch-resistance, other areas of the upper may require a relatively low degree of stretch-resistance. Because the woven textile may be utilized in areas requiring both high and low degrees of stretch-resistance, some of the yarns in the woven textile are superfluous in areas requiring the low degree of stretch-resistance. In this example, the superfluous yarns add to the overall mass of the footwear, without adding beneficial properties to the footwear. Similar concepts apply to other materials, such as leather and polymer sheets, that are utilized for one or more of wear-resistance, flexibility, air-permeability, cushioning, and moisture-wicking, for example.

As a summary of the above discussion, materials utilized in the conventional upper formed from multiple layers of material may have superfluous portions that do not significantly contribute to the desired properties of the upper. With regard to stretch-resistance, for example, a layer may have material that imparts (a) a greater number of directions of stretch-resistance or (b) a greater degree of stretch-resistance than is necessary or desired. The superfluous portions of these materials may, therefore, add to the overall mass and cost of the footwear, without contributing significant beneficial properties.

In contrast with the conventional layered construction discussed above, upper 30 is constructed to minimize the presence of superfluous material. Foundation element 31 provides a covering for the foot, but may exhibit a relatively low mass. Tensile 41 are positioned to provide stretch-resistance in particular directions and locations, and the number of tensile strands 41 is selected to impart the desired degree of stretch-resistance. Accordingly, the orientations, locations, and quantity of tensile strands 41 are selected to provide structural components that are tailored to a specific purpose.

For purposes of reference in the following discussion, four strand groups 51-54 are identified in FIGS. 1 and 2. Strand group 51 includes the various tensile strands 41 extending downward from the lace aperture 34 closest to ankle opening 31. Similarly, strand groups 52 and 53 include the various tensile strands 41 extending downward from other lace apertures 34. Additionally, strand group 54 includes the various tensile strands 41 that extend between forefoot region 11 and heel region 13.

The various tensile strands 41 that extend between lace apertures 34 and sole structure 20 resist stretch in the medial-lateral direction, which may be due to tension in lace 33. More particularly, the various tensile strands 41 in strand group 51 cooperatively resist stretch from the portion of lace 32 that extends through the lace aperture 34 closest to ankle opening 31. Strand group 51 also radiates outward when extending away from lace aperture 34, thereby distributing the forces from lace 33 over an area of upper 30. Similar concepts also apply to strand groups 52 and 53. The various tensile strands 41 that extend between forefoot region 11 and heel region 13 resist stretch in the longitudinal direction. More particularly, the various tensile strands 41 in strand group 54 cooperatively resist stretch in the longitudinal direction, and the number of tensile strands 41 in strand group 54 are selected to provide a specific degree of stretch-resistance through regions 11-13. Additionally, tensile strands 41 in strand group 54 also cross over (or may cross under) each of the tensile strands 41 in strand groups 51-53 to impart a relatively continuous stretch resistance through regions 11-13.

Depending upon the specific configuration of footwear 10 and the intended use of footwear 10, foundation element 31 may be formed from non-stretch materials, materials with one-directional stretch, or materials with two-directional stretch, for example. In general, forming foundation element 31 from materials with two-directional stretch provides upper 30 with a greater ability to conform with the contours of the foot, thereby enhancing the comfort of footwear 10. In configurations where foundation element 31 has two-directional stretch, tensile strands 41 effectively varies the stretch characteristics of upper 30 in specific locations. With regard to upper 30, the combination of tensile strands 41 with a foundation element 31 having two-directional stretch forms zones in upper 30 that have different stretch characteristics, and the zones include (a) first zones where no tensile strands 41 are present and upper 30 exhibits two-directional stretch, (b) second zones where tensile strands 41 are present and do not cross each other, and upper 30 exhibits one-directional stretch in a direction that is orthogonal (i.e., perpendicular) to tensile strands 41, and (c) third zones where tensile strands 41 are present and cross each other, and upper 30 exhibits substantially no stretch or limited stretch. Accordingly, the overall stretch characteristics of particular areas of upper 30 may be controlled by presence of tensile strands 41 and whether tensile strands 41 cross each other.

Based upon the above discussion, tensile strands 41 may be utilized to form structural components in upper 30. In general, tensile strands 41 resist stretch to limit the overall stretch in upper 30. Tensile strands 41 may also be utilized to distribute forces (e.g., forces from lace 33) to different areas of upper 30. Accordingly, the orientations, locations, and quantity of tensile strands 41 are selected to provide structural components that are tailored to a specific purpose. Moreover, the orientations of tensile strands 41 relative to each other and whether tensile strands 41 cross each other may be utilized to control the directions of stretch in different portions of upper 30.

Manufacturing Process

A variety of methods may be utilized to manufacture upper 30. As an example, a conventional cording machine may be utilized to simultaneously (a) locate tensile strands 41 relative to foundation element 31 and (b) secure tensile strands 41 to foundation element 31 with securing strands 42 and backing strands 43. More particularly, the cording machine may lay tensile strands 41 against the exterior of foundation element 31 or another material element that will eventually form foundation element 31. When laid against foundation element 31, tensile strands 41 may be positioned substantially parallel to the exterior surface for a distance of at least five centimeters. While laying tensile strands 41, the cording machine may stitch over tensile strands 41 with securing strands 42 to secure tensile strands 41 to the exterior surface of foundation element 31. That is, securing strands 42 may be joined to foundation element 31 at a plurality of locations on opposite sides of tensile strands 41, sometimes with backing strands 43 in a lockstitch configuration. Depending upon the configuration of upper 30, some of tensile strands 41 may be oriented to extend between a lace area of upper 30 and an area where sole structure 20 joins to upper 30, or some of tensile strands 41 may be oriented to extend between heel region 13 and forefoot region 11. As depicted in many of the figures, a zigzag stitch that repeatedly crosses over tensile strands 41 may be used for securing strands 42.

Additionally, processes that involve winding tensile strands 41 around pegs on a frame around foundation element 31 may be utilized to locate tensile strands 41 relative to the exterior surface of foundation element 31. Once tensile strands 41 are properly located, securing strands 42 may be stitched over tensile strands 41. As depicted in many of the figures, a zigzag stitch may be used for securing strands 42.

Further Configurations

Figure 7A:
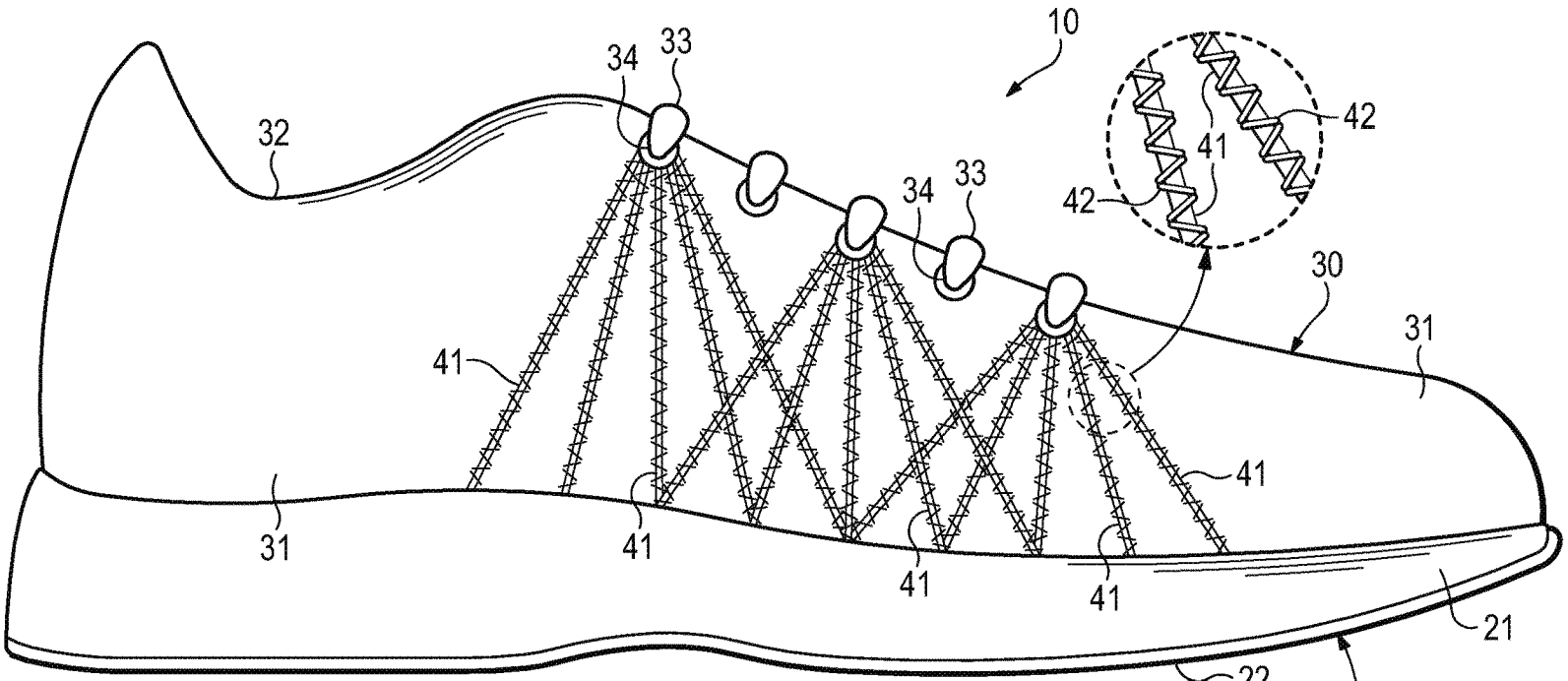
FIGS. 7A-7C are lateral side elevational views corresponding with FIG. 1 and depicting further configurations of the article of footwear.
Figure 7B:
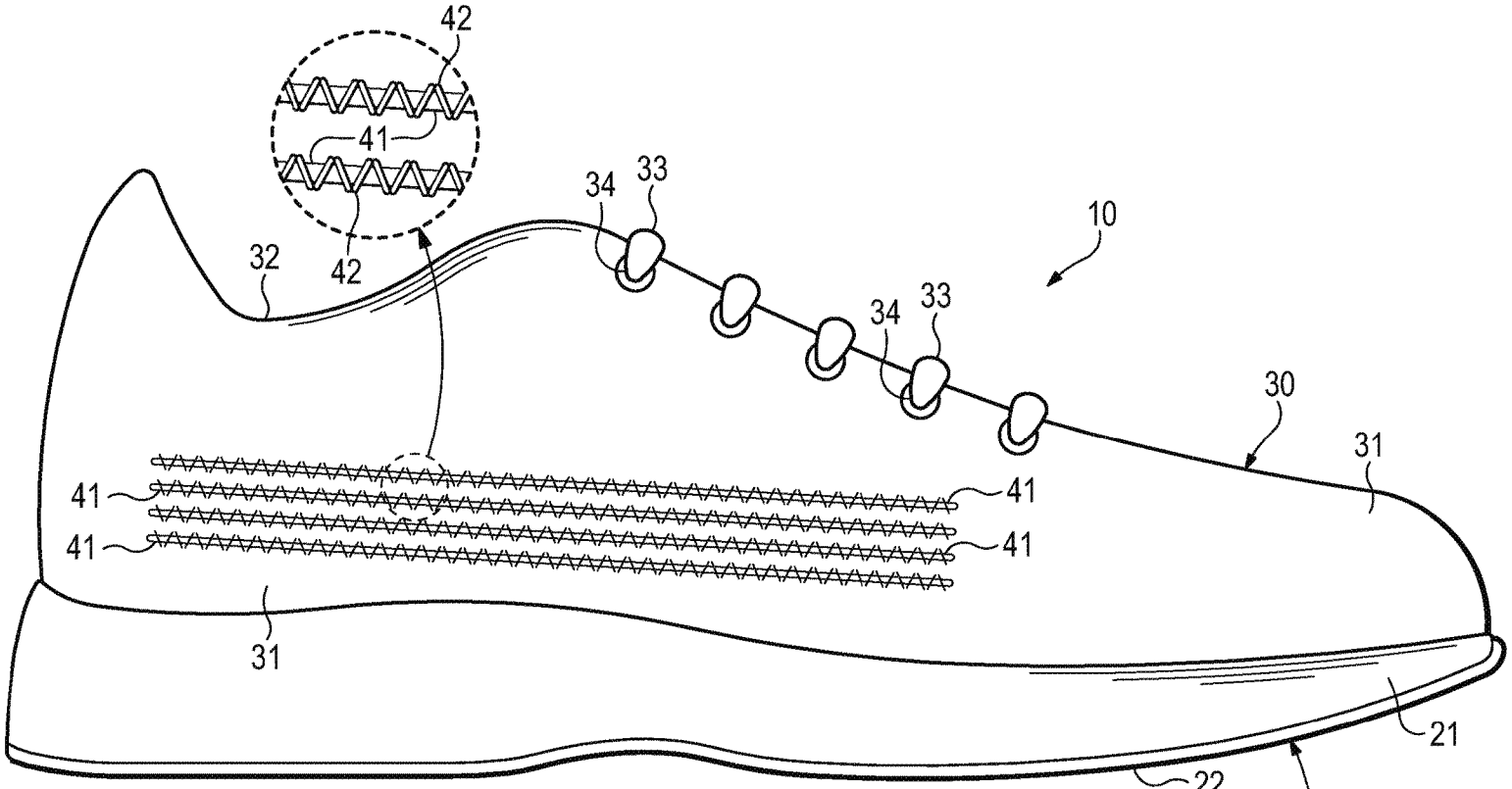
Figure 7C:
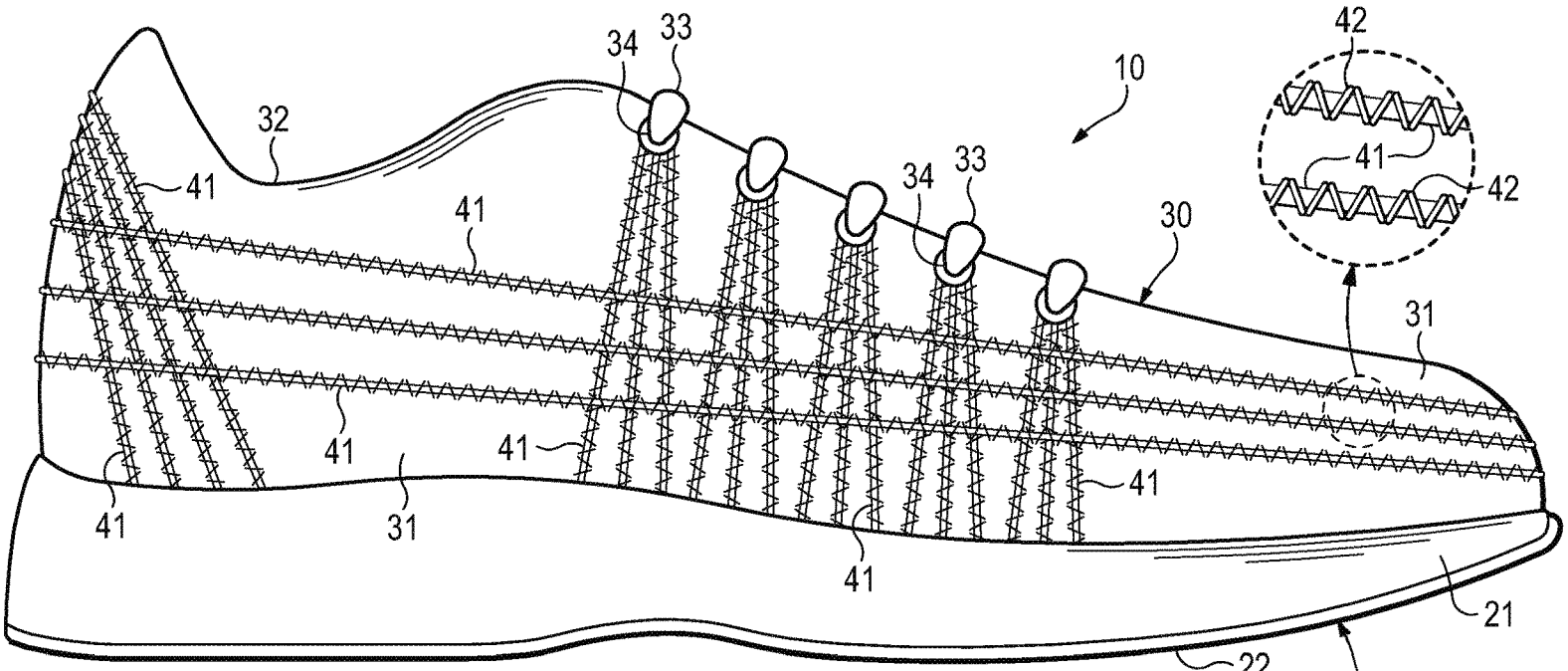

The orientations, locations, and quantity of tensile strands 41 in FIGS. 1 and 2 are intended to provide an example of a suitable configuration for footwear 10. In other configurations of footwear 10, various aspects of foundation element 31 or any of strands 41, 42, and 43 may vary considerably. An example of another configuration is depicted in FIG. 7A, wherein tensile strands 41 extending in the longitudinal direction are absent and a greater number of tensile strands 41 extend outward from each of lace apertures 34 and cross each other. In similar configurations, tensile strands 41 may only extend along the longitudinal length of footwear 10, such that tensile strands 41 extending outward from lace apertures 34 are absent, as depicted in FIG. 7B. This configuration also illustrates that tensile strands 41 may extend through only a portion of the longitudinal length of footwear 10, as well as only a portion of the distance between lace apertures 34 and sole structure 20. Referring to FIG. 7C, tensile strands 41 extend downward from each of lace apertures 34, rather than from only some of lace apertures 34. Additionally, a group of tensile strands 41 extends diagonally through the heel region to form a heel counter or other structure that limits movement of the heel within footwear 10. Accordingly, the locations of tensile strands 41, as well as the associated strands 42 and 43, may vary significantly to impart stretch resistance or other structural properties to areas of upper 30.

Figure 8A:
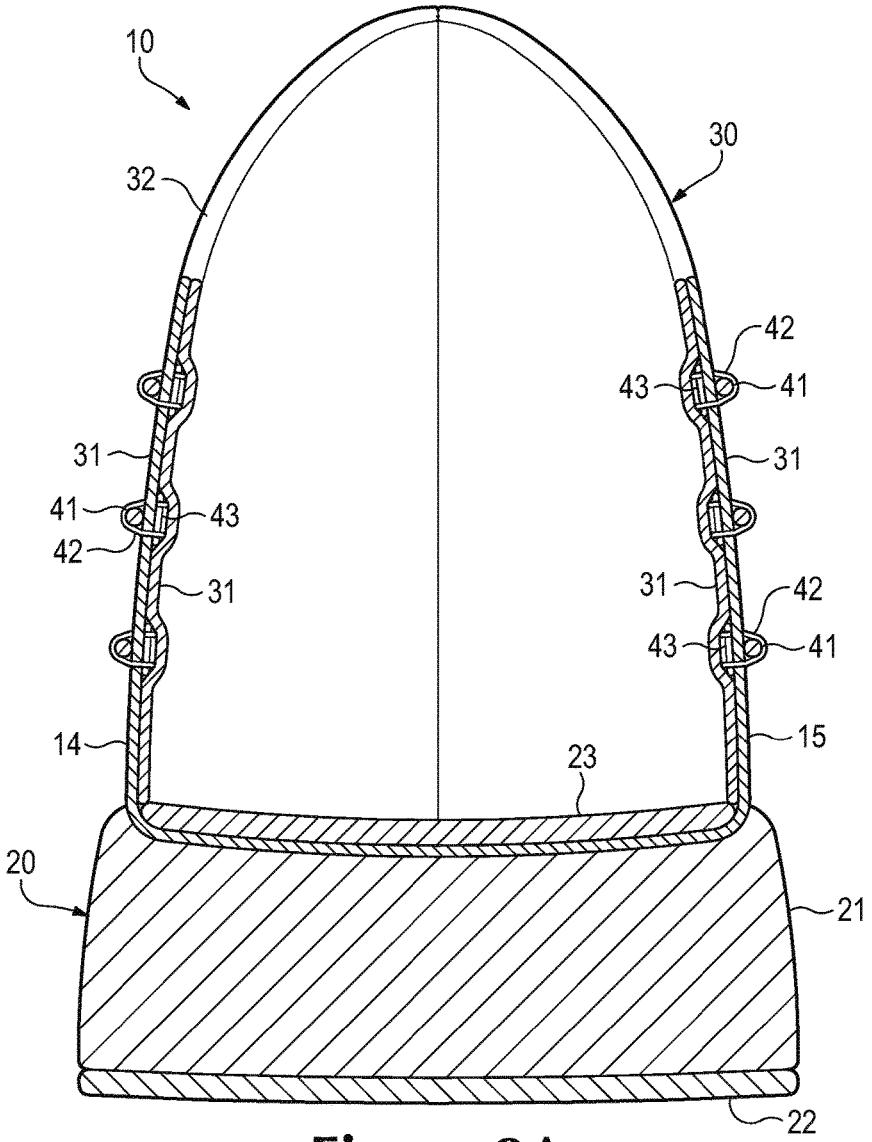
FIGS. 8A-8C are cross-sectional views corresponding with FIG. 3 and depicting further configurations of the article of footwear.

Foundation element 31 is depicted in FIG. 3 as being formed from a single layer of material. Referring to FIG. 8A, however, foundation element 31 includes two layers. As examples, the inner and outer layers may be textiles, but another central layer may be present to provide a comfort-enhancing polymer foam material. In FIG. 3, portions of securing strands 42 and backing strands 43 are located adjacent to the interior surface of foundation element 31, which may contact the foot and place pressure upon areas of the foot. In FIG. 8A, however, backing strands 43 are located on the opposite side of the outer layer, which may enhance the comfort of footwear 10.

Figure 8B:
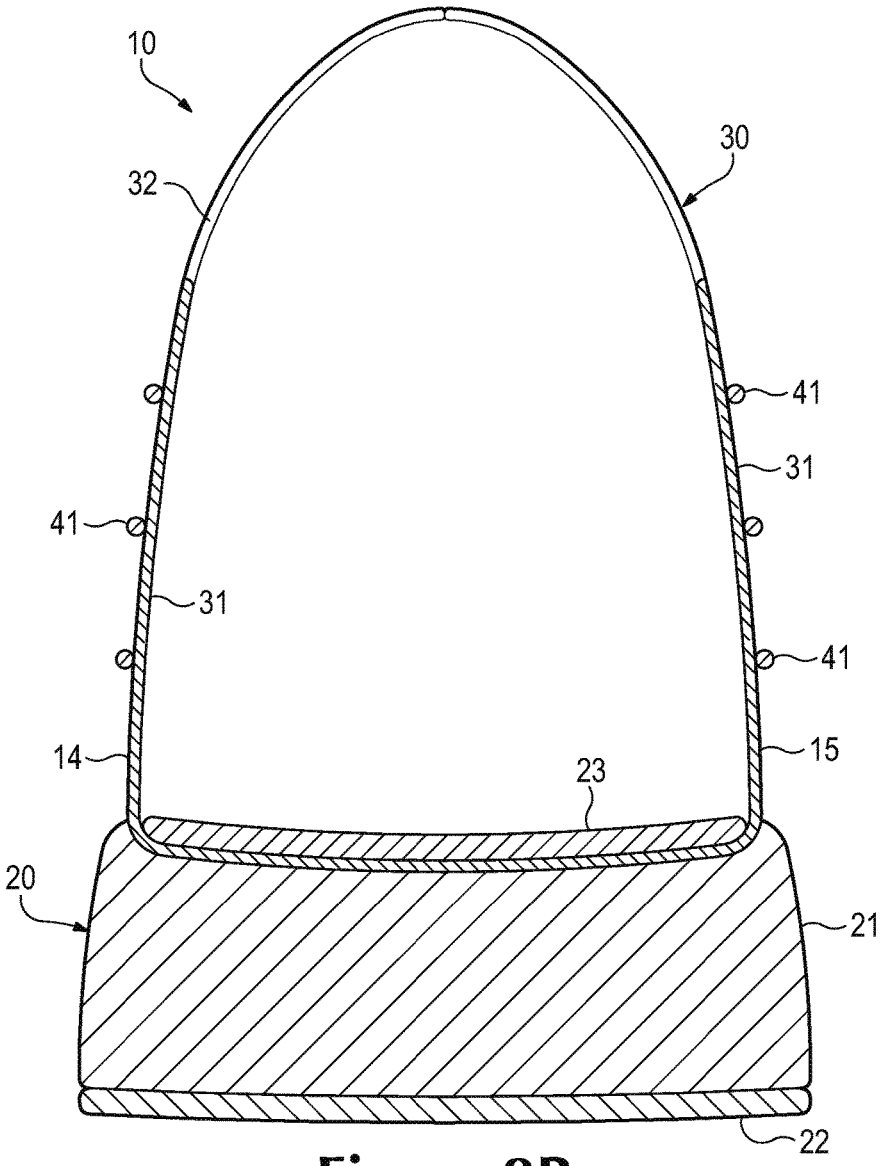

Although strands 42 and 43 are present in many configurations of footwear 10, strands 42 and 43 may also be absent, as depicted in FIG. 8B. As an example, a conventional cording machine may be utilized to locate tensile strands 41 and secure tensile strands 41 with securing strands 42 and backing strands 43. Strands 42 and 43 may, however, be formed from water-soluble materials that are dissolved away, and an adhesive may be utilized to secure tensile strands 41 to foundation element 31. In other configurations, strands 42 and 43 may be formed from thermoplastic polymer materials that melt with the application of heat and effectively secure tensile strands 41 to foundation element 31. That is, securing strand 42 may include a thermoplastic polymer material that is bonded to both the tensile strand and the foundation element. In further configurations, tensile strands 41 may be formed from a thermoplastic polymer material or may include a thermoplastic polymer material. When heated, the thermoplastic polymer material may bond with foundation element 31 to join tensile strands 41 to foundation element 31.

Figure 8C:
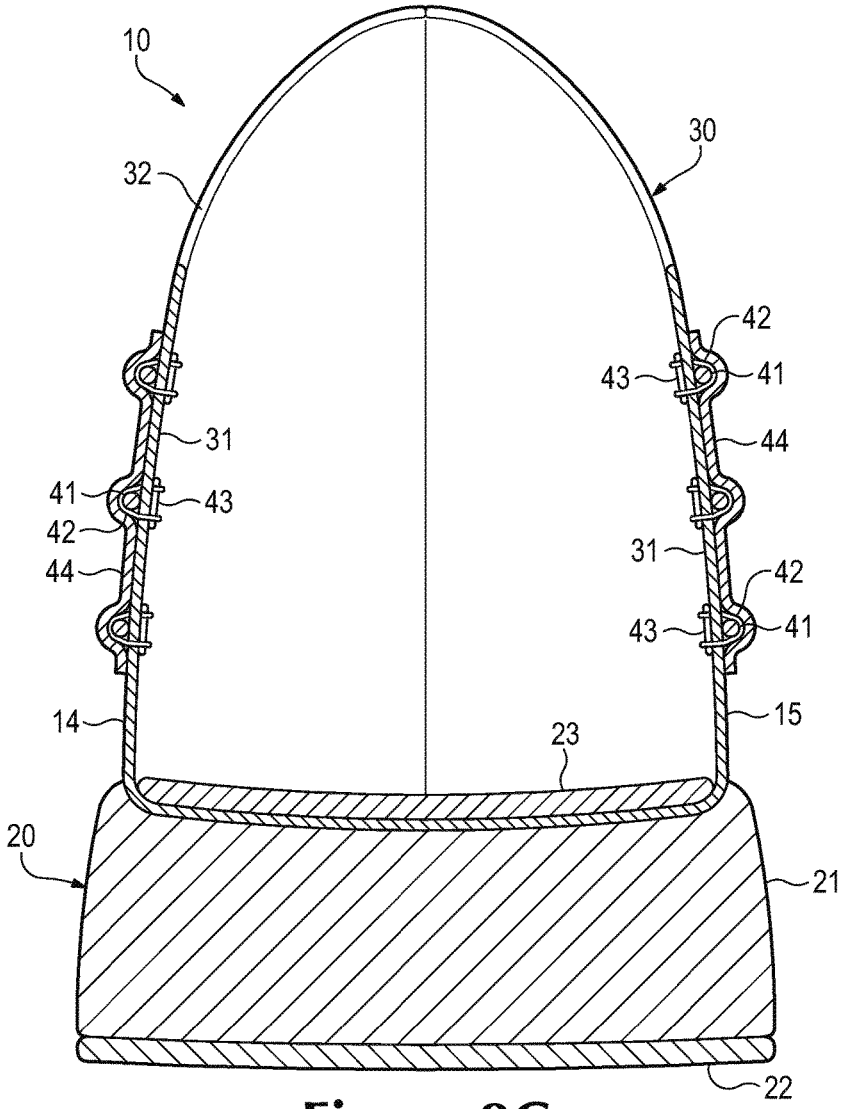

Strands 42 and 43 may be sufficient to secure tensile strands 41 to foundation element 31. In some configurations, however, a cover layer 44 may extend over the exterior surface of foundation element 31 and exposed portions of strands 41 and 42, as depicted in FIG. 8C. Cover layer 44 may, for example, be a sheet of polymer material that is bonded with the exterior of upper 30 to provide additional protection or wear-resistance to tensile strands 41.

Figure 9:
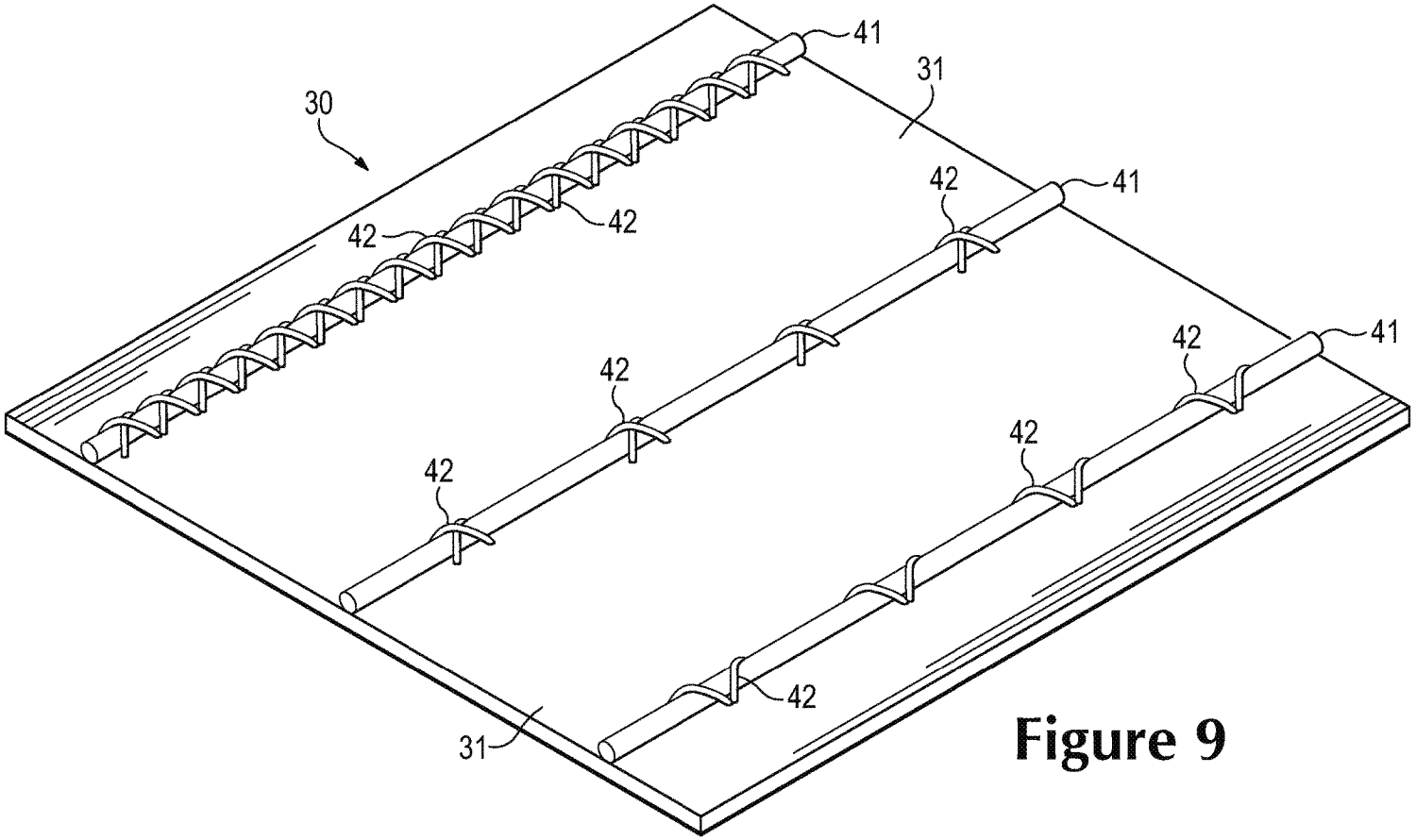
FIG. 9 is a perspective view corresponding with FIG. 4 and depicting further configurations.

In each of the prior configurations, securing strands 42 exhibited a zigzag pattern in extending over tensile strands 41. A variety of other stitch configurations may also be utilized. As examples, three additional stitch configurations are depicted in FIG. 9. More particularly, one of the stitch configurations has an x-shaped structure extending along the length of a tensile strand 41, another stitch configuration has an x-shaped structure located at specific points along the length of a tensile strand 41, and a further stitch configuration has an v-shaped structure located at specific points along the length of a tensile strand 41.

Figure 10A:
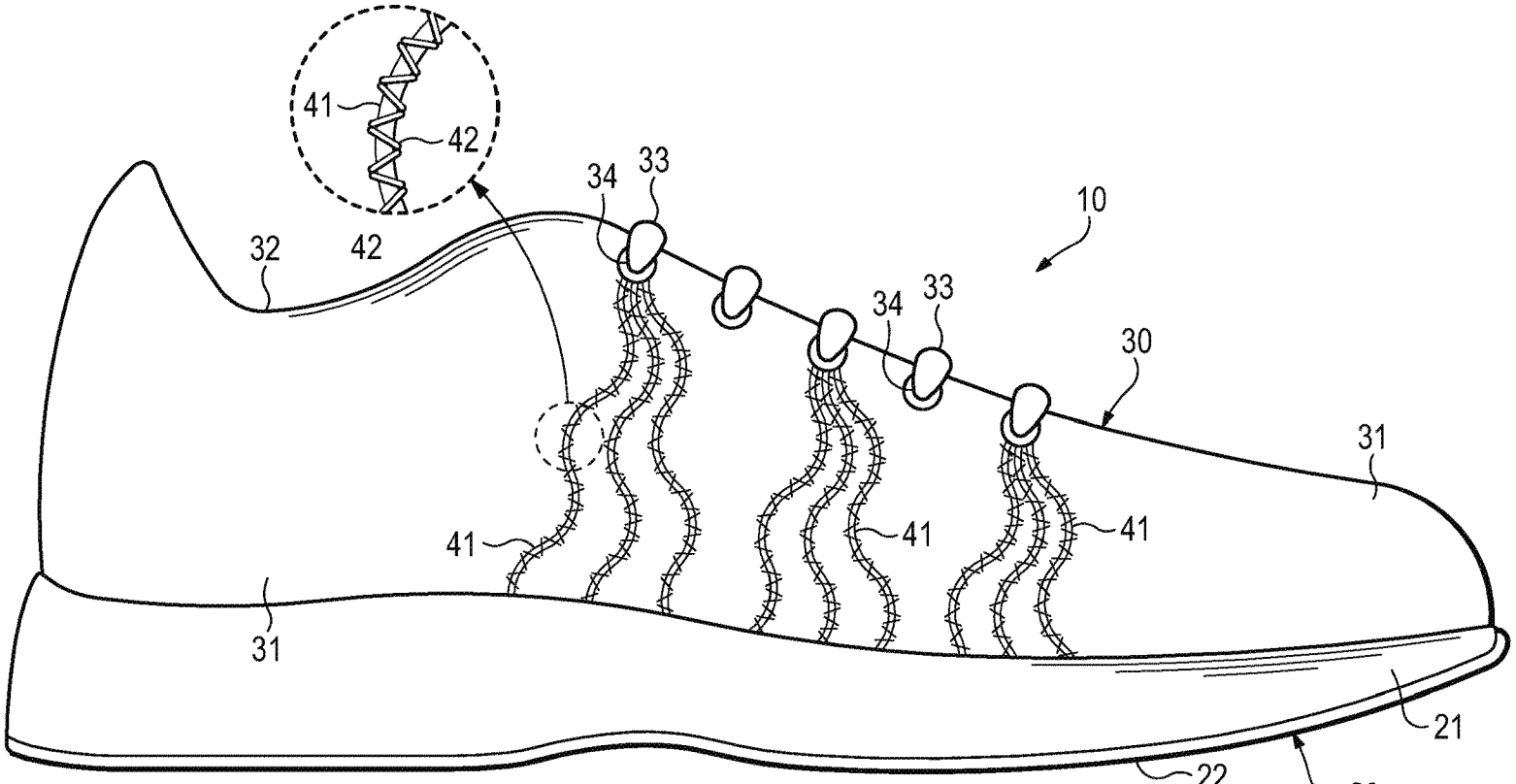
FIGS. 10A and 10B are lateral side elevational views corresponding with FIG. 1 and depicting further configurations of the article of footwear.

In each of the configurations discussed above, tensile strands 41 have a generally straight or non-curved configuration. Referring to FIG. 10A, tensile strands 41 have a wavy configuration. An advantage to imparting curvature to tensile strands 41 is that upper 30 may exhibit some stretch along the lengths of tensile strands 41 that imparts greater comfort or allows upper 30 to conform with contours of the foot. When, however, tensile strands 41 straighten due to the stretch, then tensile strands 41 may limit further stretch in directions corresponding with the longitudinal lengths of tensile strands 41. That is, imparting curvature to tensile strands 41 may impart some stretch to upper 30, while retaining the structural aspects of tensile strands 41. Given that a conventional cording machine may be utilized to lay tensile strands 41, the cording machine may be utilized to impart the curvature.

Figure 10B:
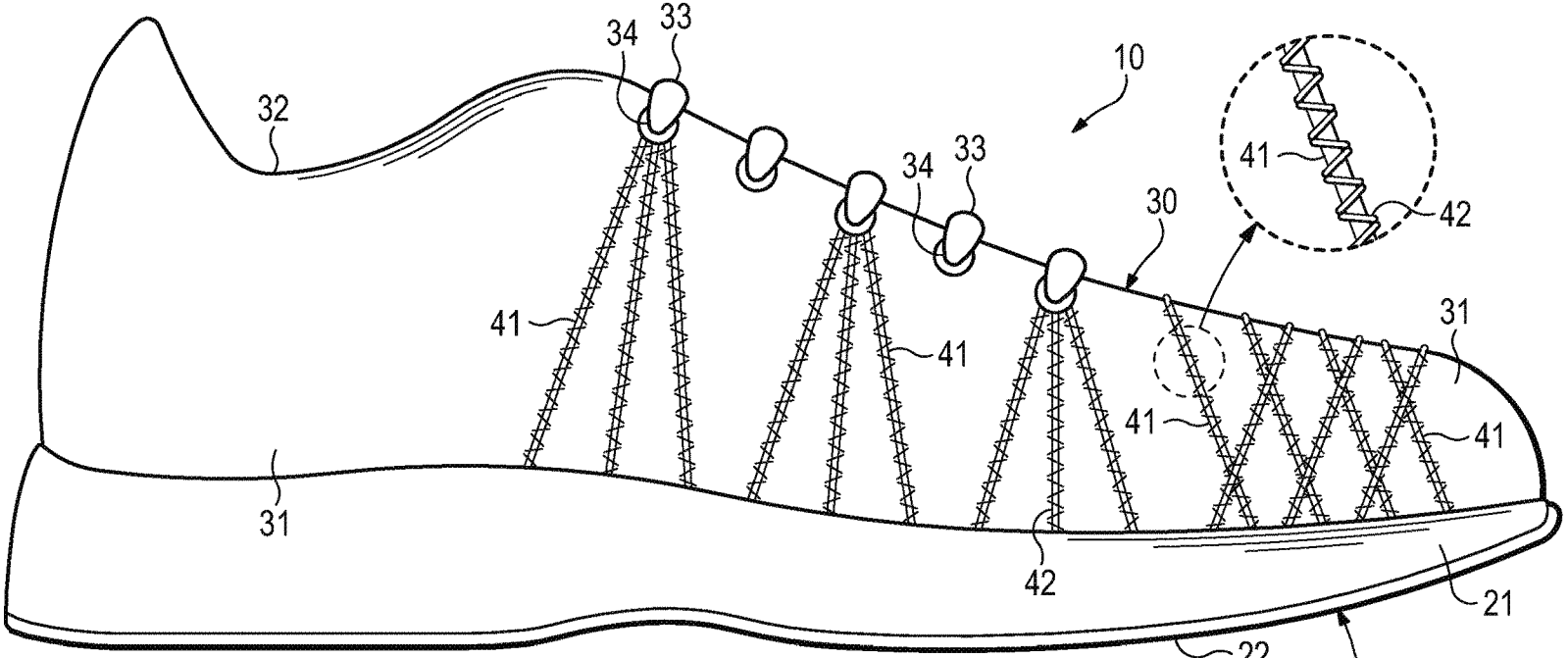

When utilizing the cording machine to lay tensile strands 41, foundation element 31 may be placed within a hoop or frame that imparts a generally flat configuration to foundation element 31. In order to incorporate foundation element 31 into upper 30, however, foundation element 31 is placed around a curved last with the general shape of a foot. That is, foundation element 31 is formed from generally flat materials and has a generally flat configuration during manufacturing, but is then incorporated into a three-dimensional structure. Referring to FIG. 10B, various tensile strands 41 are depicted in the forefoot region of footwear 10, and tensile strands 41 have a generally straight configuration. When laid upon foundation element 31 with the cording machine, however, tensile strands 41 may be located to have a curved configuration. When stretched over the last such that foundation element 31 takes on a three-dimensional shape, however, tensile strands 41 may straighten due to the curvature of upper 30. That is, tensile strands 31 may initially have a curved configuration that straightens upon incorporation into the three-dimensional structure of upper 30. Accordingly, tensile strands 41 may exhibit an initial curvature (i.e., when foundation element 31 is flat), but may later exhibit a straight configuration (i.e., when foundation element 31 is curved around a last and incorporated into upper 30).

The invention is disclosed above and in the accompanying figures with reference to a variety of configurations. The purpose served by the disclosure, however, is to provide an example of the various features and concepts related to the invention, not to limit the scope of the invention. One skilled in the relevant art will recognize that numerous variations and modifications may be made to the configurations described above without departing from the scope of the present invention, as defined by the appended claims.

What is claimed is:

1. An article of footwear having an upper and a sole structure secured to the upper, the upper comprising:

a foundation element having an interior surface and an opposite exterior surface, the interior surface defining at least a portion of a void within the upper for receiving a foot of a wearer, the foundation element including a plurality of lace apertures in a lace area of the upper;

a plurality of tensile strands located adjacent to the exterior surface and extending between the lace area of the upper and an area where the sole structure is joined to the upper;

the plurality of tensile strands comprising a plurality of strand groups each including two or more of the tensile strands, each of the plurality of strand groups having said two or more of the tensile strands oriented to radiate outward from one of the plurality of lace apertures in the lace area of the upper towards the area where the sole structure joins to the upper; and a plurality of securing strands that secures the plurality of tensile strands to the foundation element, wherein each of the plurality of securing strands extends along at least a portion of a respective one of the plurality of tensile strands that extends at least 5 centimeters, and each of the plurality of securing strands is secured to the foundation element at a plurality of locations on opposite sides of the respective one of the plurality of tensile strands along the at least 5 centimeters.

2. The article of footwear according to claim 1, wherein the plurality of strand groups include at least one tensile strand that crosses another tensile strand of another strand group.

3. The article of footwear according to claim 1, wherein the plurality of lace apertures includes at least one lace aperture where the tensile strands are absent.

4. The article of footwear according to claim 3, wherein said at least one lace aperture where the tensile strands are absent is disposed between two lace apertures that include strand groups having two or more of the tensile strands oriented to radiate outward towards the area where the sole structure joins to the upper.

5. The article of footwear according to claim 1, further comprising another plurality of tensile strands located adjacent to the exterior surface of the foundation element in a forefoot region of the article of footwear and secured to the foundation element by the plurality of securing strands.

6. The article of footwear according to claim 5, wherein the plurality of tensile strands in the forefoot region have a generally straight configuration.

7. The article of footwear according to claim 1, wherein each strand of the plurality of tensile strands has a first thickness, each strand of the plurality of securing strands has a second thickness, and the first thickness is at least three times the second thickness.

8. The article of footwear according to claim 1, wherein the plurality of tensile strands are positioned between the foundation element and the securing strands.

9. The article of footwear according to claim 1, wherein the upper includes a plurality of zones having different stretch characteristics, the plurality of zones comprising:

a first zone where the plurality of tensile strands is absent, the upper exhibiting two-directional stretch;

a second zone where the plurality of tensile strands is present and do not cross each other, the upper exhibiting one-directional stretch; and a third zone where the plurality of tensile strands is present and cross each other, the upper exhibiting limited stretch or substantially no stretch.

10. An article of footwear having an upper and a sole structure secured to the upper, the upper comprising:

a foundation element having an interior surface and an opposite exterior surface, the interior surface defining at least a portion of a void within the upper for receiving a foot of a wearer, the foundation element including a plurality of lace apertures in a lace area of the upper;

a plurality of tensile strands located adjacent to the exterior surface, at least some of the plurality of tensile strands extending between the lace area of the upper and an area where the sole structure is joined to the upper;

a plurality of zones having different stretch characteristics, the plurality of zones comprising:

a first zone where the plurality of tensile strands is absent, the upper exhibiting two-directional stretch;

a second zone where the plurality of tensile strands is present and do not cross each other, the upper exhibiting one-directional stretch; and a third zone where the plurality of tensile strands is present and cross each other, the upper exhibiting limited stretch or substantially no stretch; and a plurality of securing strands that secures the plurality of tensile strands to the foundation element, wherein each of the plurality of securing strands extends along at least a portion of a length of a respective one of the plurality of tensile strands and is secured to the foundation element at a plurality of locations along the length of the respective one of the plurality of tensile strands, and the at least a portion of the length is at least 5 centimeters.

11. The article of footwear according to claim 10, wherein the third zone is located in a midfoot region of the upper.

12. The article of footwear according to claim 10, wherein the first zone is disposed between the second zone and the third zone.

13. The article of footwear according to claim 10, the upper further comprising at least two second zones; and wherein the first zone is disposed between two of the second zones.

14. The article of footwear according to claim 10, wherein the plurality of lace apertures includes at least one lace aperture where the tensile strands are absent.

15. The article of footwear according to claim 14, wherein said at least one lace aperture where the tensile strands are absent is disposed between two lace apertures that include two or more of the plurality of tensile strands that are oriented to radiate outward towards the area where the sole structure joins to the upper.

16. The article of footwear according to claim 10, further comprising another plurality of tensile strands located adjacent to the exterior surface of the foundation element in a forefoot region of the article of footwear and secured to the foundation element by the plurality of securing strands.

17. The article of footwear according to claim 16, wherein the plurality of tensile strands in the forefoot region have a generally straight configuration.

18. The article of footwear according to claim 10, wherein the plurality of tensile strands in the second zone comprises a plurality of strand groups each including two or more of the tensile strands, each of the plurality of strand groups having said two or more of the tensile strands oriented to radiate outward from one of the plurality of lace apertures in the lace area of the upper towards the area where the sole structure joins to the upper.

19. The article of footwear according to claim 10, wherein the plurality of tensile strands in the third zone comprises a plurality of strand groups each including two or more of the tensile strands, each of the plurality of strand groups having said two or more of the tensile strands oriented to radiate outward from one of the plurality of lace apertures in the lace area of the upper towards the area where the sole structure joins to the upper; and wherein the plurality of strand groups include at least one tensile strand that crosses another tensile strand of another strand group.

20. The article of footwear according to claim 10, wherein the plurality of securing strands is formed from a thermoplastic polymer material that bonds with the foundation element when heated to join the plurality of tensile strands to the foundation element.

* * * * *